US005657822A

United States Patent [19]

James et al.

[11] Patent Number: 5,657,822

[45] Date of Patent: Aug. 19, 1997

[54] DRILL HOLE PLUGGING METHOD UTILIZING LAYERED SODIUM BENTONITE AND LIQUID RETAINING PARTICLES

[76] Inventors: Melvyn C. James, 1714 Bryan Stock Trail, Casper, Wyo. 82609; Maurice L. James, 14 Cotton Wood La., Littleton, Colo. 80121

[21] Appl. No.: 532,420

[22] Filed: Sep. 22, 1995

Related U.S. Application Data

[63] Continuation-in-part of Ser. No. 433,034, May 3, 1995.

[51] Int. Cl.[6] ..... E21B 33/13

[52] U.S. Cl. ..... 166/292; 166/180; 405/116; 405/263; 405/270

[58] Field of Search ..... 166/180, 285, 166/292; 175/72; 465/52, 55, 107, 116, 129, 263, 270

[56] References Cited

U.S. PATENT DOCUMENTS

| | | | |
|---|---|---|---|
| Re. 17,207 | 2/1929 | Collings . | |
| 1,650,864 | 11/1927 | Collings . | |
| 1,873,296 | 8/1932 | Cross . | |
| 2,064,936 | 12/1936 | McQuiston . | |
| 2,159,954 | 5/1939 | Powell . | |
| 2,329,148 | 9/1943 | Van Leeuwen . | |
| 2,348,458 | 5/1944 | Endersby . | |
| 2,609,880 | 9/1952 | Dyer . | |
| 2,734,861 | 2/1956 | Scott, Jr. . | |
| 2,945,541 | 7/1960 | Maly et al. . | |
| 3,111,006 | 11/1963 | Caron | 166/292 X |
| 3,168,139 | 2/1965 | Kennedy et al. | 166/292 |
| 3,373,814 | 3/1968 | Eilers . | |
| 3,420,299 | 1/1969 | Cloud | 166/292 |
| 3,490,535 | 1/1970 | Messenger | 166/292 |
| 3,625,286 | 12/1971 | Parker | 166/291 |
| 3,638,433 | 2/1972 | Sherard . | |
| 3,650,704 | 3/1972 | Kumura . | |
| 3,690,107 | 9/1972 | Dolfing . | |
| 3,721,043 | 3/1973 | Van Doorne . | |
| 4,137,970 | 2/1979 | Laflin et al. . | |
| 4,209,568 | 6/1980 | Clem | 405/107 X |
| 4,279,547 | 7/1981 | Clem | 405/258 |
| 4,505,751 | 3/1985 | Sydansk | 166/292 |
| 4,533,279 | 8/1985 | van den Elzen et al. . | |
| 4,634,538 | 1/1987 | Alexander | 405/264 X |
| 4,637,462 | 1/1987 | Grable | 166/245 |
| 4,651,824 | 3/1987 | Gradle | 166/245 |
| 4,674,570 | 6/1987 | Jackson . | |
| 4,736,796 | 4/1988 | Arnall | 166/292 |
| 4,836,940 | 6/1989 | Alexander | 175/72 X |
| 4,919,989 | 4/1990 | Colangelo | 166/180 X |
| 4,936,386 | 6/1990 | Colangelo | 166/292 |
| 5,013,191 | 5/1991 | Kitanaka . | |
| 5,026,214 | 6/1991 | Beck, III . | |
| 5,048,605 | 9/1991 | Toon et al. . | |
| 5,187,915 | 2/1993 | Alexander . | |
| 5,195,583 | 3/1993 | Toon et al. . | |
| 5,351,759 | 10/1994 | Nahm et al. | 166/292 X |
| 5,377,760 | 1/1995 | Merrill | 166/295 |
| 5,392,853 | 2/1995 | Toon | 166/187 |
| 5,427,990 | 6/1995 | Hughes | 501/80 |
| 5,476,543 | 12/1995 | Ryan | 166/293 X |

*Primary Examiner*—Roger J. Schoeppel

*Attorney, Agent, or Firm*—Kokjer, Kircher, Bowman & Johnson

[57] ABSTRACT

A method of plugging holes, in particular the plugging of drill holes in the earth. The method utilizes a tubular capsule filled with coarse ground sodium bentonite. The capsule, when inserted into the hole, sinks through any mud or slurry material within the hole to rest at the bottom of the hole. If the hole is filled with overly dense material, a rod may be used to force the capsules to the bottom of the hole. The capsule is constructed of a water soluble material and includes a plurality of slots cut along its exterior wall to facilitate expansion and to allow liquid to easily permeate the container. A plastic cap on its upper end allows rods to be forced thereagainst to push the capsule downward without puncturing the capsule. Alternatively, layers of sand may be interspersed with layers of bentonite nodules.

5 Claims, 3 Drawing Sheets

DRILL HOLE PLUGGING METHOD UTILIZING LAYERED SODIUM BENTONITE AND LIQUID RETAINING PARTICLES

This application is a continuation-in-part of application Ser. No. 08/433,034, filed May 3, 1995 entitled "Drill Hole Plugging Method and Capsule for Use Therewith".

BACKGROUND OF THE INVENTION

1. Field of the Invention

The present invention relates in general to filling or plugging of drill holes. In particular, the present invention relates to an improved method for plugging an abandoned drill hole within the earth and for maintaining the plug integrity indefinitely.

2. Description of the Related Art

It has been well known to provide deep (on the order of several hundred feet) drill holes within the earth for a variety of purposes. Such holes are typically formed during a standard oil well drilling operation. The drill hole is formed and then lined with a casing. The drill hole passes through several compositions, such as hard compacted soil, clay, loose sand, and other typical geologic material, in addition to one or more water bearing layers. Such water bearing layers may represent a saline water source or a fresh water aquifer. Once an oil reserve is exhausted, the oil well hole is abandoned. If left unattended, gases and fumes escape through the hole into the atmosphere. Further, the casings erode and crack, thereby causing damage to the aquifier levels and the like.

In particular, a fresh water aquifer may "leak" downward through the casing and hole into a fracture or uncharged zone, causing loss of water from the aquifer. A drill hole extending between a saline water source and a fresh water aquifer may allow commingling of these water supplies, damaging both. Additionally, contamination from the surface may cause damage, such as surface rain water passing downward through the hole and casing into a fresh water aquifer.

To overcome these problems it has been known to plug the casings and drill holes with concrete. However, concrete has proven less than effective in maintaining the integrity of the seal throughout the casing over long periods of time. First as the concrete dries, it contracts thereby separating (pulling away) from the casing. Second, as the concrete ages it cracks. These age cracks and contractions during curing produce voids within and about the concrete which allow gases to escape and allow contamination of the water level. Hence, concrete plugs have met with limited success.

In the past, finely ground chemically unaltered sodium bentonite, has been proposed for filling shallow holes of up to 30 meters or 100 feet deep. Heretofore, a system or method has not been proposed which effectively utilizes sodium bentonite to fill holes several hundred feet deep, such as oil well holes. A report entitled "Axial Shear Strength Testing of Bentonite Water Well Annulus Seals" by Fred Lee Ogden and James F. Ruff published by Colorado State University, 1989, discusses the use of bentonite as an annulus sealant. Past usage of bentonite is explained in a report entitled "Experiments in Subsurface Applications of Bentonite in Montana" by John Wheaton, Steve Regele, Bob Bohman, Dave Clark and Jon Reiten, published by Montana Bureau of Mines and Geology, 1994. Both of the foregoing reports are incorporated herein by reference.

A first and simple method for placing the bentonite in a shallow hole without a casing is to simply pour a small granular form of dry bentonite (i.e., less than ⅜" in diameter) into the drill hole from the surface. The bentonite falls downward through the drill hole, filling the hole from the bottom upward. However, where the drill hole passes through unconsolidated material, such material may form a cave in at the sides of the drill hole, forming a plug at a position spaced above the bottom of the hole. In such cases the small granular bentonite will simply fill the hole from the plug upward and not pass downward to the bottom of the hole to fully plug the hole. Additionally, it is not possible to pour bentonite in the foregoing manner into drill holes passing through high volume artisan flows, or in drill holes using a dug pit (i.e. where a bentonite slurry has been employed to maintain wall integrity in the hole).

When the small or finely ground bentonite of ⅜" in diameter is poured into the hole, it begins to expand when exposed to water. The conventional finely ground pouring method is adequate for shallow holes since the bentonite sinks to the bottom of the hole before a significant amount of swelling occurs. However, if bentonite is poured into deep oil well holes, the hole may contain several hundred feet of water.

In general, high-grade and low-grade bentonite chips fall at an average velocity of 1.0 ft/sec. Smaller bentonite granules of ⅜" in diameter or less have more surface area per unit weight, and therefore fall at a slower rate. This is due to the fact that smaller bentonite granules are typically less dense than larger chips. For instance, a bentonite granule with a diameter of ⅜" may have a volume of 0.5 $cm^3$ and weigh 1 chip with a ¾" diameter weights 3.65 grams and has a volume of 1.50 $cm^3$. In this example, the smaller granule has a density of 2.02 $gr/cm^3$ and the larger chip has a density of 2.43 $gr/cm^3$.

Further, once hydration begins, the density of the granule decreases as the granule swells. Similarly, the fall velocity of the granule in water decreases at a rate of about 0.009 ft/sec per minute of fall. For instance, a granule having an initial fall velocity of just under 1 ft/sec, after 44 minutes of exposure to water, with fall at approximately 0.6 ft/sec. As the granule absorbs water, its density decreases approaching the density of water further slowing the fall velocity. These factors prevent small granules from effectively being used to plug deep holes with several hundred feet of water therein.

The conventional form of bentonite poured into shallow holes is formed of small granular particles having a diameter of no greater than ⅜ inches. Such small material has proven ineffective when poured into holes having high fluid flow rates therethrough and when poured into deep holes retaining a high liquid level (i.e., a long distance between the hole bottom and liquid level). As the small granular material passes through the liquid, it begins to hydrate and swell. Granular bentonite having a diameter of no greater than ⅜ inches swells quickly and reaching its liquid limit (i.e., the saturation point of the bentonite). If the bentonite swells beyond its liquid limit, the bentonite turns to a slurry state. At the liquid limits, the bentonite lacks sufficient additional swelling ability to achieve seal within the hole. Hence, conventional small granular material is ineffective for filling deep holes. Additionally, the conventionally sized granular bentonite falls through the liquid in the hole in an unconcentrated state. Each granular particle is afforded a large portion of the cross-sectional area of the hole within which to expand. Sodium bentonite will continuously expand until it is restrained by its surrounding environment or starved for water. Once the bentonite expands to a size several times its dehydrated size, the conventionally sized bentonite granule loses its solid structure and turns to a slurry liquid state.

Once sodium bentonite hydrates to the point that it turns to a slurry liquid, the granule becomes ineffective at plugging holes.

Past systems that use the conventional sized bentonite particles have prevented degradation to this slurry state by filling the hole with dehydrated granular particles before each individual particle is allowed to expand substantially. To do so, the granules are poured into shallow holes or holes having very little liquid standing therein. In shallow holes, conventionally sized particles collect in the bottom of the hole before expanding substantially. However, when conventionally sized granular bentonite is poured into deep holes and through deep liquid levels, each individual particle turns to a slurry state before reaching the bottom of the hole and collecting with the other falling particles.

A second and more reliable method is to insert a conduit into the drill hole and pass a slurry of bentonite through the conduit while slowly withdrawing the conduit. For example, U.S. Pat. No. 5,013,191 to Kitanaka discloses a special auger which is rotated in the normal manner to drill the hole, and then is fixed against rotation while the bentonite slurry is passed through a central hole in the auger and the auger is withdrawn. While this method is effective, it requires the use of a special and expensive auger and is limited to shallow applications.

An alternative slurry/conduit method consists of simply inserting a standard 1½ inch PVC pipe into the drill hole and passing the slurry through this pipe. While this method does not require the use of a special auger, if the hole has been plugged as noted above, the method requires an initial step of drilling with an auger to clear the plug prior to inserting the pipe. Again, this system is limited to shallow applications.

Moreover, problems have been encountered with the above systems when using a mixture of heavy bentonite gel water slurry. The slurry mixture is used while drilling the holes to keep the walls of the drill holes from sluffing inward, thereby avoiding the need to reconstruct sluffed areas within the hole. After abandonment, the slurry stands within the hole. The density of the slurry is sufficiently close to the density of conventional granular bentonite which is poured directly into the hole, that the slurry holds the granular bentonite in suspension proximate the top section of the hole. Thus, when the granular bentonite is poured into the hole, it does not sink to the bottom, and thus does not plug the hole from the bottom up.

Moreover, the foregoing systems are ineffective when used with wet auger drilled holes which utilize water injected from the surface downward into the hole. While drilling the hole, the agitation of the auger stem, when combined with the injected water, creates a heavy native mud material that remains within the hole after drilling is completed. The density of this mud is relatively high, with respect to that of bentonite granular material, and thus holds the bentonite granular material in suspension at the top of the hole.

Finally, in any plugging application (shallow or deep) utilizing bentonite, the bentonite retains the ability indefinitely to expand or contract depending upon its degree of hydration. Thus, the bentonite remains in a swollen state to plug the hole so long as it remains adequately hydrated. If the bentonite dries out, it contracts, thereby compromising the seal within the hole. Therefore, it is necessary to ensure that the bentonite is continuously and indefinitely exposed to liquid or at least used in an application designed to prevent liquid loss. Past shallow applications using fine bentonite have failed to acknowledge or address this problem, in part due to the fact that shallow holes are generally exposed to a natural water table which provides a continuous source of liquid. Further, past shallow fine bentonite applications utilize a column of bentonite less than 100 feet long within a hole which does not necessarily contain a casing. In these shallow applications, natural water from the water table and run-off water from the surface provide adequate and indefinite hydration of the entire bentonite column.

However, in deep holes much longer columns of bentonite are required. Plus, when a hole casing is used, so long as it retains its integrity, the interior of the column is isolated from ground water and underground water tables. Hence, any bentonite within the column may dry out and contract, thereby compromising the seal integrity.

A need remains within the industry for an improved method and apparatus for plugging abandoned drilled holes. It is an object of the present invention to meet this need.

SUMMARY OF THE INVENTION

An object of the present invention is to provide a method of plugging holes which is simple, inexpensive and effective.

Another object of the present invention is to provide such a method which may reliably seal water supplies from contamination and loss in holes passing into the earth.

Another object of the present invention is to provide such a method which will clear any plugs from the hole and reliably pass plugging material to the bottom of the hole.

It is a further object of the present invention to provide a plurality of capsules containing bentonite chips, of which the capsules may be dropped into a hole and ensured to sink to the bottom of the hole.

It is a corollary object of the present invention to provide a capsule which affords minimal interference with expansion of the bentonite therein to fill the hole, such interference being minimized through the inclusion of a plurality of slots cut through the outer casing of the capsule which also function to maximize communication between the liquid outside the capsule and the bentonite inside.

Another object of the invention is to prevent the bentonite, once used to plug a hole, from dehydrating and compromising its sealing ability.

A corollary object of the invention is to provide layers of sand or gravel between layers of bentonite to retain moisture which maintains the bentonite in an expanded state at all times.

These and other objects are achieved by a method of plugging holes, in particular the plugging of drill holes in the earth. The first method consists of inserting an auger, having a bit at the lower end and a central rod about which is formed a helical land, into the drill hole and rotating the auger to cause material to be conveyed upward and out of the drill hole. As the auger is moved downward this will cause any plugs or debris within the hole to be removed. After the auger has been inserted to a sufficient depth the rotation of the auger is reversed, and bentonite or other plugging material is poured into the drill hole about the auger. The reversed rotation of the auger will cause the plugging material to be conveyed downward along the drill hole and compacted at the bottom. As the drill hole is filled with compacted plugging material the auger is slowly removed to form a consistent reliable plug of the plugging material. Alternative embodiments are used to fill the hole, including the use of encapsulated bentonite, large nodule sized bentonite and a hollow canister remotely dumped into the hole. Also, the bentonite may be layered with sand or gravel sections.

BRIEF DESCRIPTION OF THE DRAWINGS

The objects and features of the invention noted above are explained in more detail with reference to the drawings, in which like reference numerals denote like elements, and in which.

BRIEF DESCRIPTION OF THE INVENTION

Figure 1:
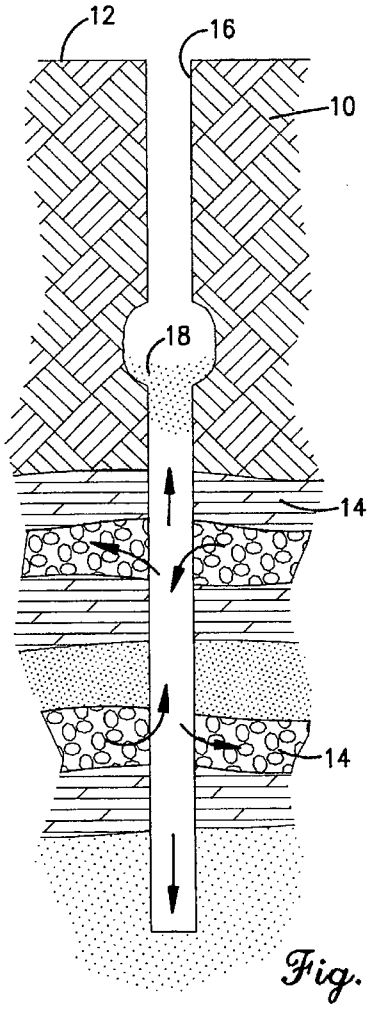
FIG. 1 is a cross sectional view illustrating an abandoned drill hole.

With reference to FIG. 1, there is shown a mass of material 10 having an outer surface 12. The mass 10 may be uniform, or formed of a plurality of disparate layers. In the embodiment shown in FIG. 1, the mass 10 is the earth, and includes a plurality of layers of geologic material formed in layers roughly parallel to the surface 12. For example, the upper surface 12 would be formed of soil with the lower layers formed of shale, sand, limestone, and other typical materials. Additionally, such layers may include one or more water sources 14 such as a saline source or a water aquifer.

A drill hole 16 extends into the mass 10 from the surface 12. The hole 16 extends through several of the layers, possibly including one or more water source layers 14. As may be envisioned, where the hole 16 passes through one or more of the water bearing layers 14, such water bearing layer is subject to contamination from material falling into the hole 16 and from other water bearing layers 14, and is also subject to loss due to flowing downward through the hole 16 and into a fracture or uncharged zone, or of passing upwardly and out of the hole 16 in the case of a high volume artisan flow, all as indicated by arrows in FIG. 1. Another common feature of such holes 16 is a plug formation 18. The plug formation 18 is formed of a mass of material which has broken away from the side walls of the hole 16 and has become interengaged to block the hole 16, even though the remainder of the hole below the plug may be open.

As noted above, when the purpose of the hole 16 has been completed the hole may be termed abandoned. For such abandoned holes it is highly desirable to plug the holes, typically with bentonite (of the type indicated above), to protect the water bearing layers 14. To effect such a plugging there is introduced into the holes 16 a standard auger drill having at its lower end a bit 20, an elongated central shaft 22 and a helically extending land formed on the exterior of shaft 22. The shaft and land are formed in segments which may be connected end-to-end to provide an auger drill of the proper depth.

As is known in the art, the auger drill is rotated in the direction of arrow 26 as it is forced downward into the hole 16 (or into the solid mass 10 to form the hole 16) such that the helical lands 24 will engage the particulate material generated by bit 20 and convey the particulate material towards the surface 12 with the side walls of the hole 16 acting as a surrounding sleeve. Once upon the surface 12 the particulate material will fall from the helical land and accumulate on the surface 12 adjacent the hole 16.

Figure 2:
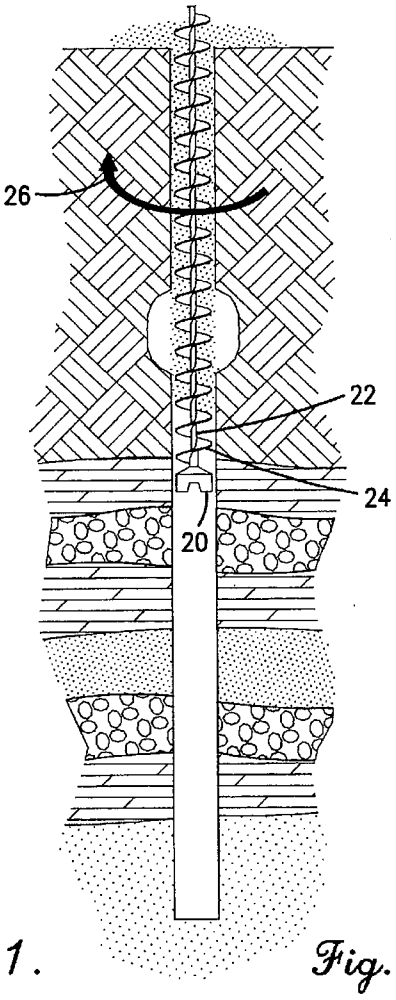
FIG. 2 is a cross sectional view illustrating the clearing of the drill hole according to the present method.

As may be readily envisioned from FIG. 2, the use of the standard auger drill will clear any plug formations 18 present in the hole 16. Additionally, the auger drill is typically somewhat flexible, such that it may more readily follow existing abandoned holes 16, rather than drilling a separate or new hole. As such, continued rotation and insertion pressure upon the auger drill will eventually result in the drill extending the desired depth into the hole 16. If desired, the auger drill may continue to be rotated without downward pressure, such that all or most material engaged within the helical land is transported to the surface 12. Once the desired amount of particulate material has been removed from the hole and helical land, rotation of the auger drill is stopped.

At this point the plugging material 28, preferably bentonite as described above, is poured into the hole 16 at the surface 12 while rotating the auger drill in the opposite direction, as indicated by arrow 30. Due to the opposite rotation of the auger drill, the helical land 24 will force material downward into the hole 16. Any remaining material within the helical land and the plugging material 28 will be thus be conveyed downward. At the lower end of the helical land this material will fall downward due to gravity.

As the bit 20 of the auger drill is adjacent the lower end of hole 16 due to the previous steps, and is preferably below any water bearing layers 14, the remaining particulate material and the plugging material 28 will be reliably displaced into the bottom of hole 16 below the water bearing layers 14. The process will continue, with additional plugging material 28 falling below the auger drill, eventually filling the volume below the auger drill. Continued rotation of the auger drill and introduction of plugging material 28 will eventually cause compaction of the plugging material for even greater reliability.

Once the volume below the auger drill bit 20 has been filled and possibly compacted, the rotation in the direction of arrow 30, and introduction of plugging material 28, is continued as the auger drill is raised out of hole 16. This raising of the auger drill may be at a slow continuous rate or may be in incremental steps. Regardless of the manner of raising, the overall rate should be such that a sufficient amount of the plugging material 28 is deposited along the hole 16, possibly with compacting as described above.

This process will continue until the hole 16 has been filled with the plugging material 28 at least to a level above the water bearing layers 14. Of course, this process could continue until the entire hole 16 has been filled with plugging material 28, or at least substantially filled such that plugging material may be introduced easily, without voids, after total withdrawal of the auger drill.

As may be readily envisioned, the present method will reliably remove any debris plugs from the hole, and will reliably place the plugging material along the desired length of the hole 16, without the need to remove the auger drill. The present method therefore provides a high-quality plug without high labor costs and without expensive specialized drills. However, in many situations augers are not useful or necessary when plugging holes. FIGS. 4–9 illustrate alternative embodiments which may be used in place of an auger system, such as for extremely deep holes and the like.

Figure 4:
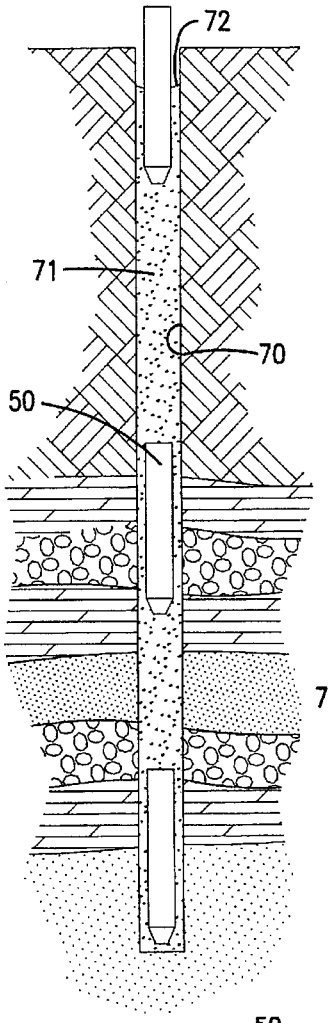
FIG. 4 illustrates an alternative embodiment in which capsules are dropped into a drill hole to plug same.
Figure 5:
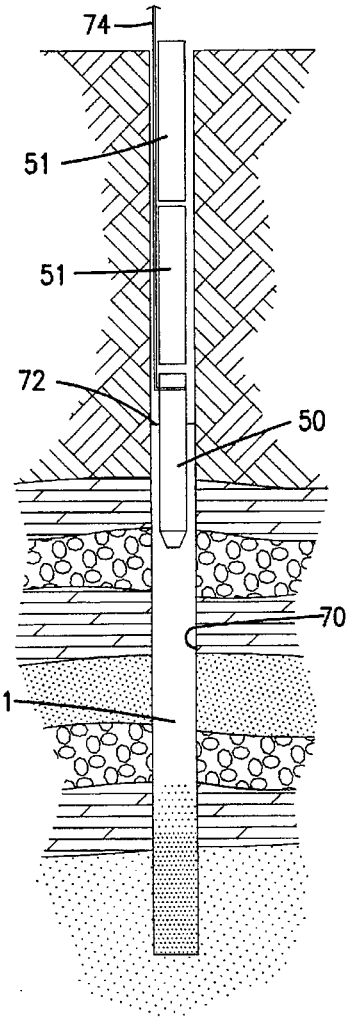
FIG. 5 illustrates an application of the alternative embodiment which uses a separate line to gauge and control the application of capsules in overly deep holes.
Figure 6:
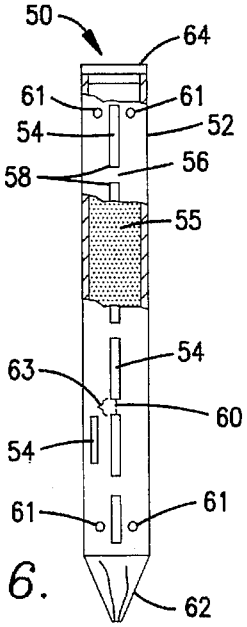
FIG. 6 illustrates an exemplary cross-sectional side view of a capsule according to the second embodiment.

FIGS. 4–6 illustrate an alternative embodiment which utilizes a plurality of capsules 50 (FIG. 4) to fill each abandoned hole 70. The capsules 50 contain coarse ground sodium bentonite 55 and have sufficient density to displace free standing material, such as water, slurry and mud, within the hole. The capsules 50 sink through the free standing liquid within the hole to assure that the capsules (and thus the bentonite) fill the hole from the bottom up. The capsules are inserted one after the other until the hole is filled to the desired level. If the hole contains mud having a density greater than that of a capsule 50, the user may push the bentonite capsules through the mud with one or more interconnectable rods (not shown) abutted against the rear surface of each capsule.

As shown in FIG. 6, each capsule 50 includes a liquid soluble exterior cylindrical wall 52, such as one formed of cardboard, a water soluble material and the like. The cylindrical wall 52 includes a plurality of slots 54 cut therein. In the preferred embodiment, each slot extends in a direction substantially parallel to the longitudinal axis of the cylindrical wall 52. In the preferred embodiment, the slots 54 are aligned end to end with one another and separated via spacing wall segments 56. The dimensions of the slots 54 and wall segments 56 may vary, so long as adjacent ends 58 of slots 54 are located proximate one another and are separated by less than a maximum wall segment distance 63. This maximum segment distance 63 is dictated by the dimensions of the capsule and the structural integrity of the material forming the wall 52.

By way of example only, if a cardboard wall 52 is included with a thickness of approximately ¼ inch, it is preferable to utilize a segment distance 63 of no greater than two inches and preferably less than one inch. When the sodium bentonite 55 expands, the wall segments 56 fracture between adjacent slots 54 to minimize the confining forces created by the wall 52 and to facilitate the expansion of the sodium bentonite 55 within the hole. This fracture is illustrated in FIG. 6 via the dashed line 60. Hence, the slots and wall segments 54 and 56 regulate the expansion rate to an extent. The slots 54 also provide a vehicle for allowing the liquid within the hole to penetrate the capsule and hydrate the sodium bentonite 55.

As shown in FIG. 6, the wall 52 includes a lower end 62 which may be tapered to form a point. This point may be formed by merely crimping the cylindrical side wall at the lower end 62. The point enables the capsule to propagate easily through the material within the hole. A cap 64 is provided at the upper end of the wall 52 to close the capsule 50. The cap 64 may be formed of plastic or a similarly rigid material and is removable to facilitate filling of the capsule with sodium bentonite. As shown in FIG. 6, a plurality of vent holes 61 are also provided within the cylindrical wall to prevent moisture buildup within the capsule 50 during storage and to allow liquid to enter and air to leave the capsule 50 when in use.

FIGS. 4 and 5 illustrate two alternative methods for inserting the capsules 50 into a hole. FIG. 5 illustrates an extremely deep hole 70, such as an oil well hole, containing water or a similarly viscous liquid 71 up to a level 72. The liquid within the hole 70 has a density less than that of a capsule 50 and thus the capsule 50 sinks through the liquid without assistance. While loosely poured coarse bentonite may not have a density greater than certain liquids 71 in the hole, the weight of a capsule with the closely packed bentonite therein affords such a density. Hence, the weight of the capsule plus the weight of the bentonite therein overcome the frictional forces exerted upon the exterior of the capsule by the heavy liquids 71, and the capsule 50 sinks.

FIG. 5 illustrates a relatively deep hole, such as 50 feet or greater, with a liquid level 72 substantially below the ground level. In this situation, it may be preferable to attach a wire line or twine 74 to the bottom most capsule and lower same into the hole 70 at a controlled rate, thereby preventing the impact with the liquid level 72 from breaking the capsule. A plurality of capsules 51 may be inserted immediately after the lowermost capsule and piggybacked downward into the hole. Optionally, piggybacking capsules need not be formed with a tapered lower end. The line 74 also allows the user to measure the depth to which the lowest capsule 50 sinks. Once the capsule 50 has sunk to the bottom of the hole, the user cuts the line 74.

In an alternative system, with holes having a higher liquid level 72 and when the user need not measure the depth to which the capsule 50 sinks, the line 74 is omitted. Instead, the capsule 50 is simply inserted into the hole and allowed to sink through the material 76 in the hole 70. If the material 76 has a density greater than that of the capsules 50, the user may insert one or more rods into the hole to push downward upon the top end cap 64 of each capsule to force same to the bottom of the hole 70.

Once the capsules 50 are inserted into the hole, the water soluble exterior wall 52 begins to deteriorate rapidly. Simultaneously, the walls 52 and slots 54 allow liquid to enter the capsule and initiate rehydration. As the walls deteriorate and the liquid seeps through the slots 54, the water begins to hydrate the sodium bentonite 55. As the sodium bentonite 55 hydrates, it swells causing interior pressure upon the cylindrical wall 52. This pressure causes the fracture 60 between each of the slots 54 until each of the slots 54 in one line communicate with one another without any separating wall segments 56. The wall 52 continues to deteriorate as the sodium bentonite 55 expands until the sodium bentonite fills the entire inside diameter of the hole 70 creating a solid plug which prevents movement of the liquid within the hole.

Optionally, the slots 54 may be aligned in a staggered arrangement about the perimeter of the cylindrical wall 52 while maintaining wall segments 56 within the desired dimension between adjacent ends 58 of adjoining slots 54. As a further option, a plurality of rows of slots 54 may be used and aligned about the perimeter of the cylindrical wall 52.

Preferably, the sodium bentonite 55 is formed of coarse, dry, dehydrated, ground chips having a dimension between 2 inches and ¼ inch in diameter, and optimally between ⅞ inch and 1 inch in diameter. The coarse, ground bentonite 55 typically swells to between 12 and 15 times its original size once hydrated. The ability of the bentonite to swell to this volume depends upon the availability of water and the space within the hole. Under ideal hole conditions, the swelling effect of the bentonite will create a pressure of up to 250 PSI within the hole. This swelling effect will halt any water flow within the bore hole thus providing greater protection for ground water. In this manner, the sodium bentonite prevents the co-mingling of various water sources, such as a saline water source with a fresh water aquifier. The swollen sodium bentonite further prevents surface contamination which results when water is allowed to flow downward into a hole to mix with a fresh water aquifier. The sodium bentonite further prevents the depletion of shallow aquifers within the hole via a fracture or uncharged zone.

It is preferable to use at least a 2½ inch capsule in a 4 inch casing, a 3 inch capsule in a 4½ inch casing, a 3½ inch capsule in a 5½ inch casing and a 5 inch capsule in a 7 inch casing.

Figure 7:
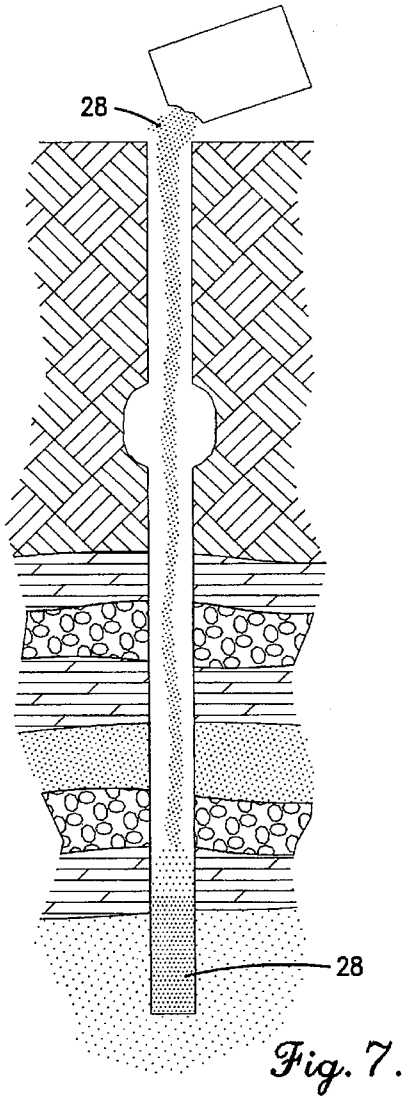
FIG. 7 illustrates an alternative embodiment in which large nodules of bentonite are poured into a drill hole.
Figure 3:
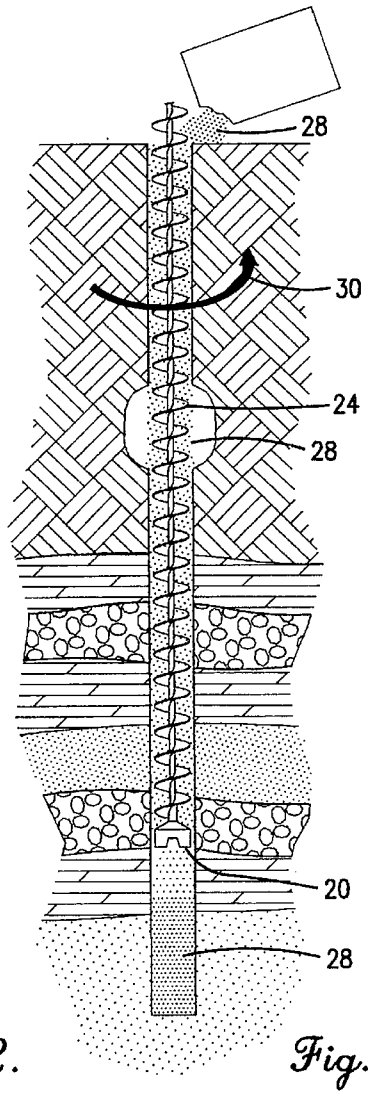
FIG. 3 is a cross sectional side view showing the conveyance of plugging material through the abandoned drill hole to fill same.

FIG. 7 illustrates an alternative embodiment in which the sodium bentonite is formed into large nodules that are poured into the hole in a free format, such as from a sack, bag, bucket and the like. The bentonite may be also discharged from a conveyor on a storage truck and the like. The bentonite is formed from large nodules having a predetermined minimum diameter of preferably at least ⅞ inches and optimally of at least 2 inch. By utilizing large nodules, the material is afforded time to float or fall to the bottom of the drill hole before expanding to the point at which it plugs the hole.

Each nodule expands at a rate proportional to the percentage content of liquid within the nodule. The rate at which a nodule absorbs liquid is dependent upon its surface area. The rate of hydration is related to the surface area of the nodule and to the volume of the nodule. However, the volume and surface area of a nodule vary with respect to nodule diameter at differing rates. Thus, when a spherical nodule's diameter doubles, the surface area similarly doubles, while the volume more than doubles. For this reason, as a nodule's diameter doubles, the amount of liquid absorbed by a nodule per unit time also doubles, while the volume of the nodule more than doubles. As the nodule increases in volume, it requires an equal increase in the amount of absorbed liquid to maintain a particular hydration ratio. The ratio of nodule surface area to nodule volume decreases as the nodule increases in diameter. Accordingly, the rate of hydration decreases (as does the rate of expansion) with increased nodule size.

As noted above, it is necessary that the nodules have a diameter of at least ⅞ inches and less than 2 inches. A nodule with a diameter of less than ⅞ inches hydrates and expands too rapidly to allow the nodule to reach the bottom of a deep hole before plugging the hole. By way of example, fine bentonite particles with a ⅜ inch diameter may hydrate and swell to 10 times its original size and turn to a slurry state in less than 15 minutes. Often drill holes are several hundred feet deep with over a hundred feet of liquid. Each nodule falls at a rate dependent upon the nodule's density and the liquid's viscosity. However, generally the viscosities of the bentonite and the liquids within the holes is such that a nodule having a ⅜ inch diameter falls at a rate of 60 feet per minute. As the nodule swells its density decreases, further educing its fall velocity. Such nodules require several minutes to reach the hole's bottom. Accordingly, ⅜ inch nodules swell and plug the hole before reaching the bottom or turn to a slurry state otherwise.

Nodules having a ⅞ inch or greater diameter swell at a much slower rate. Nodules with a ⅞ diameter also decrease in density (with swelling) at a slower rate due to the larger volume, thereby allowing the nodules to reach the bottom before plugging the hole.

Nodules according to the present invention preferably have a maximum diameter of no greater than 3 inches and optimally no greater than 2 inches. Optimally, a combination of nodules, having varying diameters between 1 inch and 2 inches, are used. Nodules between 1 and 2 inches will fall through liquid for at least ½ hour without excess swelling (i.e., increasing by less than 30% in volume) which is sufficient to reach the bottom of any hole. By way of example, it is desirable to arrest the rate of expansion to less than a 50% increase in volume after exposure to liquid for 30 minutes, and optimally less than 30% increase.

Figure 8:
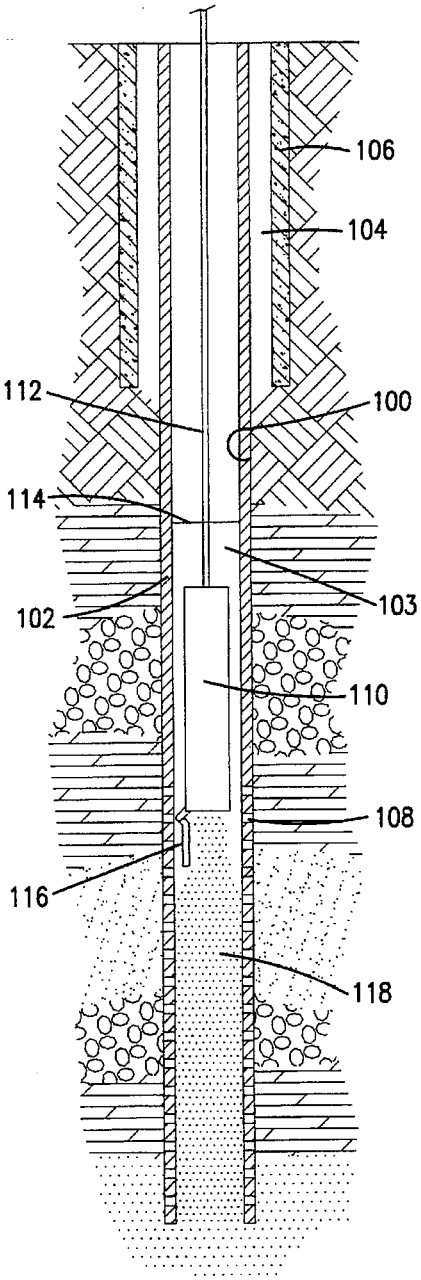
FIG. 8 illustrates an alternative embodiment in which a large canister is lowered into a hole and remotely opened to drop sodium bentonite into the hole.

FIG. 8 illustrates an alternative embodiment in which a hole 100 is lined with a casing 102. Such holes may be several hundred feet deep. The hole 100 includes an inner diameter which is larger than the outer diameter of the casing to form an annulus void 104 about the casing. The upper portion of the hole includes a cement liner 106 formed against the inner diameter of the hole.

The lower end of the casing 102 includes perforations 108 which allow the product of interest to enter the interior 103 of the casing and to be pumped therefrom during production.

As a further alternative embodiment, a canister 110 may be provided which is cylindrical in shape and hollow. The canister stores a large quantity of sodium bentonite either loose or in capsule form. The canister is air tight and water tight. A cable or hose 112 is attached to the upper end of the canister in order to allow users to lower the canister into the casing to a desired depth. Once the canister 110 is lowered to the desired depth (which may be above or below the water level 114), the user remotely opens the bottom end 116 of the canister. The bottom end 116 is hingeably mounted to the canister and may be open via an electronic solenoid or a mechanical lever, either of which are remotely activated by the user at the top of the hole. Once the door 116 is opened, the sodium bentonite 118 falls from the bottom of the canister and collects at the bottom of the hole. By using an air tight and water tight canister 110, the sodium bentonite is isolated from exposure to the liquid until the canister is at a desired depth. This depth may be immediately adjacent the bottom of the hole. If the canister 110 is lowered to the bottom of the hole, a variety of sodium bentonite sizes may be utilized, ranging from an extremely small granule to large nodules. In the embodiment of FIG. 8, the size of the granule is not critical when the canister 110 is lowered to the bottom of the hole prior to subjecting the sodium bentonite to the liquid. However, if it is preferable to maintain the canister 110 at a great distance above the bottom of the hole and even above the water level, then it is necessary to use larger diameter nodules of sodium bentonite (as discussed above in connection with FIG. 7) in order to allow the nodules to reach the bottom of the hole before turning to a slurry state or swelling to such a degree as to plug the hole.

As is understood in the industry, the casing, hole and liner arrangement illustrated in FIG. 8 is commonly encountered. This casing and liner alignment may be utilized in cooperation with any of the above discussed embodiments.

During operation, it is often desirable to perform several pre-plugging and post-plugging steps to facilitate the use of sodium bentonite. As is well known in the industry, many types of drill holes such as oil wells and gas wells are lined (once drilled) with a casing (as shown in FIG. 8). Product is pumped through the casing perforations during production. The outer diameter of the casing is slightly smaller than the inner diameter of the hole. Initially, a wire line is lowered down to the bottom of the hole to determine whether the casing is entacted and to locate the water level. Next, a packing is lowered into the hole to a position immediately above the perforations. The packing forms an air tight seal with the wall of the casing. The casing integrity is tested by applying high pressure air (e.g., 500 PSI) to the hole and determining whether this pressure is "bled off" through cracks in the casing. If the casing holds the air pressure, then the casing wall is air tight from the packing to the top of the hole. If the casing wall is air tight, then sodium bentonite only need be loaded to a desired point above the perforations (approximately 100 feet above the perforations). If the casing integrity is bad and it is unable to sustain the high pressure casing test, then a bridging plug is set below the hole and a 100 foot sodium bentonite plug is displaced above this point. By filling the hole 100 feet above the bridging plug with sodium bentonite, cracks in the casing are sealed and the potential for water migration within the hole arrested.

Once the casing is tested, the sodium bentonite is added by one or more of the foregoing manners to the desired level. The sodium bentonite is allowed to expand and seal the hole. Thereafter, the seal is tested by again pressurizing the hole (e.g., to 500 PSI) and determining whether the pressure is maintained. Next, an additional portion of sodium bentonite is added at the top of the hole about the outer perimeter of the casing into the annulus void between the production casing and surface casing. This additional portion of sodium bentonite seals the outer region surrounding the casing. Finally, an end cap is sealed over the opening.

In all of the foregoing embodiments, it is necessary to control the ratio of the volume of bentonite versus the volume of hole. If too little bentonite is added it turns to a slurry state before the hole walls arrest its growth at a solid state. It is desirable to fill a hole with at least 40% by volume of dehydrated sodium bentonite in order that it may react with the remaining 60% by volume of water within the hole.

When estimating an amount of necessary bentonite, 2–3 inches of additional expansion must be accounted for in order to allow for casing failure. When the casing fails, the bentonite expands to the inner diameter of the hole. The sodium bentonite previously stored in the hole further swells and is able to fill this additional 2–3 inches in diameter since liquid is present in the hole thereby causing the bentonite to swell no matter how much time has past.

If a plastic capsule is used, it will prevent hydration of the bentonite until the capsule reaches the bottom and dissolves. The plastic capsule may be formed with an accelerator additive to increase the dissolution rate of the plastic.

In the canister embodiment of FIG. 8, pressurized air or water may be added to the full canister to force the bentonite out of the canister when the door is opened.

Figure 9:
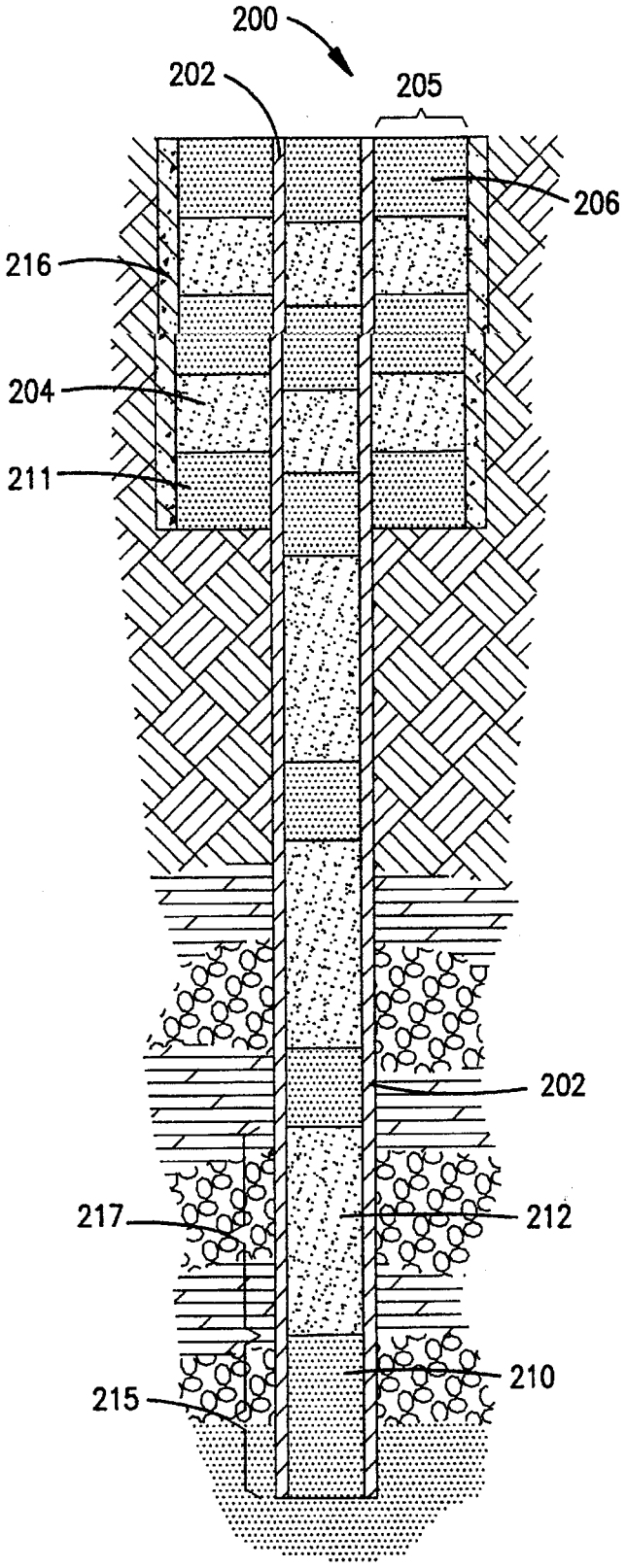
FIG. 9 illustrates an alternative embodiment in which layers of bentonite are separated by layers of sand or gravel.

FIG. 9 illustrates an alternative embodiment which may be utilized with any of the preceding methods for plugging shallow or deep holes. The embodiment of FIG. 9 is set forth in connection with a deep hole, such as several hundred feet deep as used with oil wells. FIG. 9 illustrates a hole 200 lined with a casing 202. The upper portion of the hole 100 includes an inner diameter which is larger than the outer diameter of the casing to form an annulus void 204 about the casing. The upper portion of the hole 200 includes a liner 206 formed against the exterior diameter of the void 204.

According to this embodiment, layers of sodium bentonite 210 are injected into the hole according to the preceding methods. The layers of sodium bentonite 210 are separated with layers of sand 212, gravel or a similar liquid retaining or porous particulate material. To form this layered structure, a lowermost section of sodium bentonite is introduced into the hole (according to one of the preceding methods) until it reaches a desired depth 215. Thereafter a portion of sand is poured into the casing 202 to a depth 217. This process is repeated alternately pouring bentonite and sand into the hole until the hole is filled. As illustrated in FIG. 9, the thickness of each layer may be varied depending upon its location within the hole and other factors. Once the casing 202 is completely filled with bentonite and sand layers, the void 205 about the exterior of the casing 202 is similarly filled with layers of bentonite 211 and sand 204. Within the void 205, the bentonite 211 and sand 204 are repeatedly layered until the void is filled.

Optionally, sand may be omitted and a similar type of material substituted therefore, so long as the material exhibits a liquid retention characteristic and delivers this liquid as need to adjacent bentonite layers. By layering sand and bentonite in this manner, each layer of bentonite is continuously and indefinitely exposed to water which is stored within the adjacent sand layers. Hence, liquid retained within the sand layers prevents the bentonite layers 215 from dehydrating and contracting, thereby maintaining a seal within the casing 202.

The sand layers further function to prevent overexpansion of the bentonite layers. As explained above, when bentonite is exposed to water, it hydrates and swells, up to 10–12 times its original volume. However, when bentonite expands to this volume, it liquifies and loses its structural integrity, thereby losing its ability to seal. Hence, when the bentonite over expands, it weakens its sealing ability as a plug.

If left unattended, the bentonite 211 within the voids 205 about the upper portion of the casing 202 would continue to hydrate until it liquified or turned to a slurry state. However, expansion of the bentonite along the column is arrested by covering each layer of bentonite 211 with a layer of sand 216. The sand exerts downward pressure upon the bentonite with sufficient force to counteract the expansion forces of the bentonite, thereby arresting expansion. Hence, the sand limits upward migration of the bentonite, thereby directing the bentonite to expand laterally against the walls of the casing 202 and liner 206. The foregoing effect of the sand upon the bentonite layers occurs throughout the hole and throughout the void 204.

The combination of layered sand and bentonite functions to produce downward hydrostatic pressure within the hole to prevent gases and fluids from entering the well hole and the casing. In this manner, the inventive combination of sand and bentonite plugs the drill well hole and indefinitely maintains a seal.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A plugged drill hole having an opening at a surface and a bottom end, comprising:

a first layer of partially hydrated sodium bentonite, within the hole and expanded to form a plug sealing a portion of said hole, said first bentonite layer being located at the bottom of said hole; and a first layer of non-bentonite particulate material in the hole and located immediately above said first bentonite layer, said first particulate layer providing liquid after expansion to said first bentonite layer to prevent dehydration and contraction thereof.

2. A plugged drill hole according to claim 1, further comprising:

a second layer of partially hydrated sodium bentonite in the hole and located immediately above said first layer of particulate material.

3. A plugged drill hole according to claim 1, further comprising:

multiple layers of expanded sodium bentonite separated by layers of sand.

4. A plugged drill hole according to claim 1, wherein said particulate material comprises sand.

5. A plugged drill hole according to claim 1, wherein said hole contains a casing having a void about said casings upper portion proximate the surface, said layers of bentonite and particulate material filling said void.

* * * * *